US007043173B2

(12) United States Patent
Grune et al.

(10) Patent No.: US 7,043,173 B2
(45) Date of Patent: May 9, 2006

(54) TONER HOPPER ENGAGEMENT DEVICE, A TONER CONTAINER, AND A TONER REFILL KIT

(76) Inventors: Guerry L. Grune, 784 Villier Ct., Virginia Beach, VA (US) 23452; Richard Irving Stow, II, 8102 Roanoke Ave., Hampton, VA (US) 23605-1638

( * ) Notice: Subject to any disclaimer, the term of this patent is extended or adjusted under 35 U.S.C. 154(b) by 0 days.

(21) Appl. No.: 10/787,134

(22) Filed: Feb. 27, 2004

(65) Prior Publication Data

US 2005/0191085 A1 Sep. 1, 2005

(51) Int. Cl.
*G03G 15/08* (2006.01)

(52) U.S. Cl. ..... 399/106; 222/DIG. 1; 399/120; 399/262

(58) Field of Classification Search ..... 222/DIG. 1; 399/120, 258, 260, 261, 262, 263, 106
See application file for complete search history.

(56) References Cited

U.S. PATENT DOCUMENTS 4,942,432 A 7/1990 Mort et al.
5,089,854 A 2/1992 Kaieda et al.
6,209,995 B1 4/2001 Grune et al.
6,314,262 B1 * 11/2001 Kunihiro et al. ..... 399/258
6,421,518 B1 * 7/2002 Floyd et al. ..... 399/258

* cited by examiner

*Primary Examiner*—Hoang Ngo
(74) *Attorney, Agent, or Firm*—Oblon, Spivak, McClelland, Maier & Neustadt, P.C.

(57) ABSTRACT

A hopper engagement device includes a base member having an orifice releasably engaging with a toner container. The orifice is provides an interference fit with an opening of the container. The engagement device includes a sealing member on the container wherein the sealing member includes an adhesive portion configured to engage an outer surface of a lid. When the lid is opened, the sealing member is peeled off from an opening of the container. A toner refilling kit includes a hopper engagement device having an orifice and a toner hopper container having a removable sealing member having an adhesive portion. The adhesive portion engages an outer surface of a hopper cover when the container engages the hopper engagement device. A toner container includes an opening and a sealing member attached to the opening. A refill kit includes a base member having an orifice and a toner container.

33 Claims, 9 Drawing Sheets

TONER HOPPER ENGAGEMENT DEVICE, A TONER CONTAINER, AND A TONER REFILL KIT

BACKGROUND OF THE INVENTION

1. Field of the Invention

The invention relates to devices for refilling image forming apparatuses with toner, and particularly to a toner hopper engagement device for engagement with a sliding cover type toner hopper so as to allow the refilling of such a toner hopper. The invention also provides a toner container and a toner refill kit which can be utilized to more conveniently refill a sliding cover type toner hopper.

2. Discussion of the Background

Image forming apparatuses, such as printers, photocopiers and facsimiles, typically apply a thermosetting image forming substance such as dry ink or what is commonly referred to as "toner," in order to form images on paper. As image forming processes are performed, the toner is eventually depleted and therefore, must be refilled. Known image forming apparatuses are constructed with an array of devices related to refilling the toner reservoir included in the image forming apparatus. For example, a toner reservoir or "hopper" in an image forming apparatus may have a sliding lid that is opened by hand, thereby allowing toner to be poured into the reservoir, from a specialized toner refilling container. After the hopper is refilled, the specialized container is disengaged and discarded or returned to the manufacturer for refilling.

For example, referring to FIGS. 8–13, a refilling operation using a known refill container is shown. As shown in FIGS. 8 and 9, an access panel 12 of image forming apparatus 10 is rotated downward to expose toner hopper release lever 14 and toner hopper 16. As shown in FIG. 9, after hopper release lever 14 is rotated downwardly, as viewed in FIG. 8, toner hopper 16 can be pulled outwardly, in a direction of arrow 18, so as to expose engagement surface 20 of toner hopper 16. Although FIGS. 8 and 9 depict a toner hopper that can be pulled outwardly from an image forming apparatus, hopper 16 may be fixed within image forming apparatus 10 whereby access is enabled through additional access panels.

FIGS. 10–13 illustrate a refilling operation of toner hopper 16. As shown in FIG. 10, toner hopper 16 includes engagement surface 20 which has various receptacles 22 for receiving corresponding protrusions 24 provided on an engagement plate 26 of toner refill cartridge 28. Engagement surface 20 also includes lip 30 for engaging rear edge 32 of hopper refill cartridge 28. Toner hopper 16 also includes handle 34 which allows a user to slide toner lid 36 to thereby open orifice 38 so as to allow hopper 16 to be refilled with toner. A free end 40 of film 46 extends beyond an edge of plate 26, as shown in FIG. 10.

During a refilling operation, as illustrated in FIGS. 11-13, toner hopper 28 is engaged with engagement surface 20 of toner hopper 16. As shown in FIG. 11, rear edge 32 of toner hopper 28 is engaged with lip 30 of surface 20. Furthermore, although not shown in FIG. 11, protrusions 24 are engaged with receptacles 22. As shown in FIG. 11, toner refill cartridge 28 is filled with toner 42 and is sealed along its bottom surface 44 with film 46. Typically, film 46 is bonded to surface 44 so as to provide a complete seal over the opening 48 of toner refill cartridge 28. As shown in FIG. 11, film 46 is approximately twice as long as toner refill cartridge 28. A first length of film 46 covers opening 48 of cartridge 28. A second length of film 46 is wrapped around first slide plate 50. In order to open refill cartridge 28, a user pulls handle 34 of hopper 16 in the direction of arrow 52. As shown in FIG. 12, by pulling handle 34 in the direction of arrow 52, hopper lid 36 is moved in the direction of arrow 52. As shown in FIG. 13, by pulling on free end 40 generally in the direction of arrow 52, slide plates 50 and 54 are also moved in the direction of arrow 52 and film 46 is peeled away from surface 44 of cartridge 28. As plates 50 and 54 are moved in the direction of arrow 52, toner 42 provided in cartridge 28 is thereby allowed to fall into hopper 16. After the contents of cartridge 28 are depleted, handle 34 can be returned to its initial position, and cartridge 28 can be removed. Thereafter, cartridge 28 can be returned to the manufacturer for refilling. Since the film 46 is peeled away from cartridge 28 only after cartridge 28 has been engaged with surface 20 of hopper 16, accidental spillage and dispersal of toner 42 during a refilling operation is effectively prevented. A shortcoming of the above-described toner refill arrangement is that specialized refill containers are complex and must be manufactured with strict tolerances due to the various couplings required for engaging and interacting with each specific toner hopper. As a result, expensive tooling costs are incurred in making the molds and other equipment used to manufacture the specialized containers, and even after the initial equipment costs, the manufacture and assembly of the specialized containers is costly. Thus, the specialized containers can add significant overhead costs to operating and maintaining image forming apparatuses. In addition, if a business has a number of different types of photocopiers, an inventory of different specialized toner refill containers must be maintained. Therefore, it is desirable to simplify and minimize the costs involved with refilling toner reservoirs of image forming apparatuses.

SUMMARY OF THE INVENTION

It is an object of the present invention to provide a device for reducing the complexity and costs associated with refilling toner reservoirs of image forming apparatuses. It is a further object of the invention to provide a toner hopper engagement device which allows a specialized toner hopper to be filled with a generically-shaped toner container, while preventing accidental or inadvertent spillage of toner during a refilling operation.

These and other objects of the invention can be provided by the present invention, which provides a toner hopper engagement device. A base member is configured to engage a toner hopper of an image forming apparatus which has a sliding-type toner hopper lid. A first orifice is provided on the base member and is configured to allow toner to pass through the base member into the hopper.

The present invention further provides a toner container. A toner storage portion has an opening. A sealing member is attached to the opening. An adhesive portion is provided on the sealing member and has an adhesive on at least a portion of the adhesive portion which does not face an interior of the toner storage portion.

The present invention still further provides a toner refill kit. A base member is configured to engage a toner hopper of an image forming apparatus which has a sliding-type toner hopper lid. A toner container has a toner storage portion and an opening. A first orifice is provided on the base member and is configured to allow toner to pass through the base member into the hopper, the first orifice being releasably engagable with the opening.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION OF THE PREFERRED EMBODIMENTS

Examples of preferred embodiments of the present invention will now be described with reference to the drawings, wherein like reference numbers throughout the several views identify like and/or similar elements.

Figure 1:
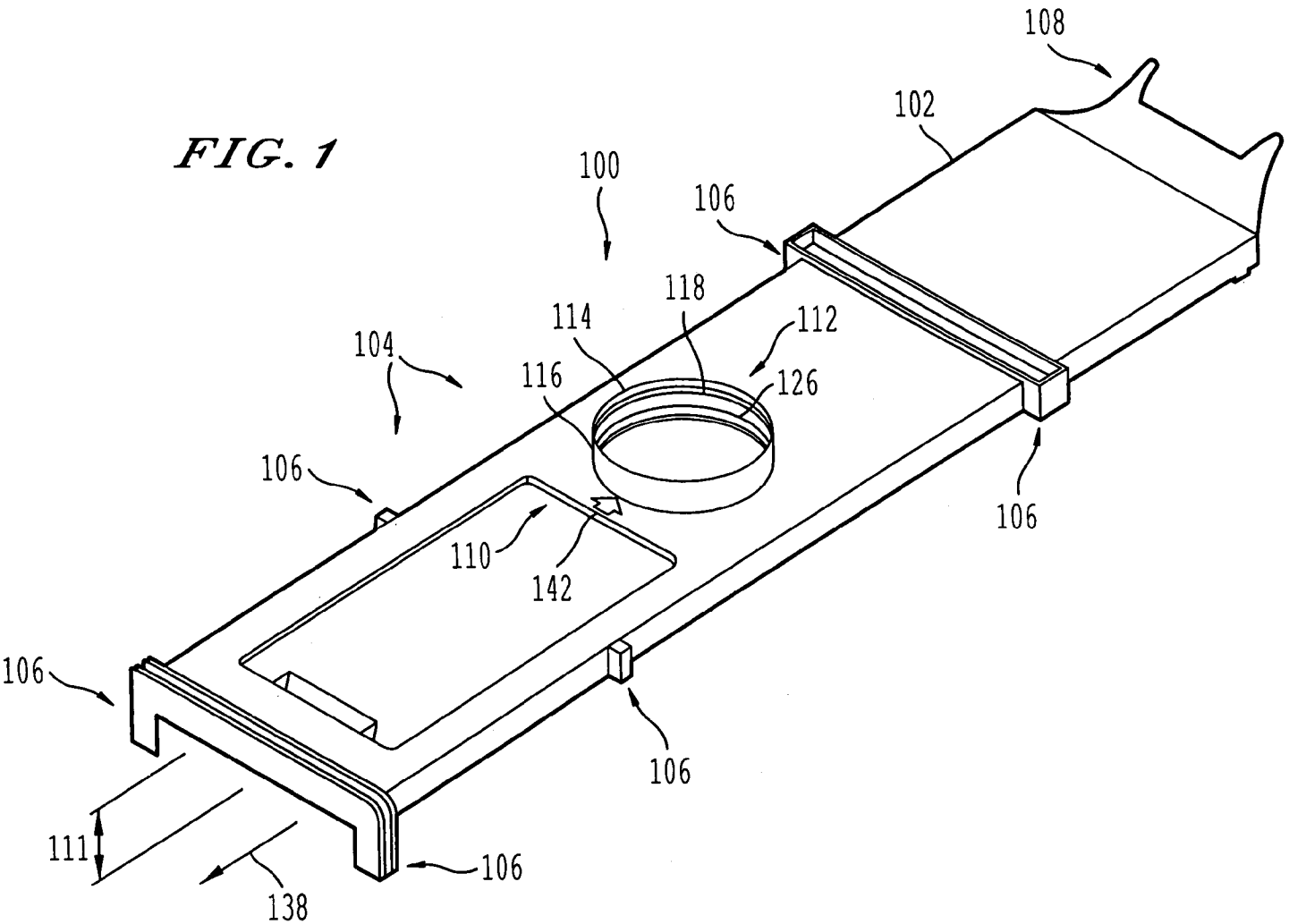
FIG. 1 is a perspective view of a toner hopper engagement device according to the present invention.

FIG. 1 illustrates a toner hopper engagement device according to the present invention. As shown in the figure, the toner hopper engagement device 100 includes base member 102, and at least one orifice 104. According to the invention, base member 102 is configured to engage with an engagement surface of a toner hopper, such as engagement surface 20 of toner hopper 16 shown in FIG. 10. However, it is to be understood that base member 102 may be configured to engage with any known toner hopper.

In order to engage with a toner hopper, base member 102 may include any combination of protrusions and/or receptacles, such as protrusions 106 which are configured to be received by receptacles provided on a toner hopper. For example, protrusions 106 may be configured to be received by receptacles 22 of toner hopper 16 shown in FIG. 10. Additionally, base member 102 may include tooth 108 for engaging lip 30 of toner hopper 16, for example.

Orifice 104 is configured to be releasably engagable with a toner container. Although orifice 104 may have any shape, orifice 104 and base member 102 are preferably configured to prevent inadvertent or accidental spillage or dispersal of toner. For example, orifice 104 may be in the form of a rectangular orifice 110 or an annular orifice 112. Preferably, if orifice 104 is in the form of rectangular orifice 110, orifice 110 is configured to allow toner to be poured into the toner hopper while preventing inadvertent or accidental spillage or dispersal of toner. For example, if orifice 110 is too large, toner powder may float out of the toner hopper and through orifice 110. Therefore, orifice 110 should be constructed small enough so that dispersal of toner through the orifice is substantially prevented, while the remainder of base member 102 substantially forms a seal with a toner hopper, thereby preventing spillage or dispersal of toner during a refilling operation.

For example, as shown in FIG. 1, orifice 110 is located approximately at the end of base member 102 opposite from tooth 108. However, orifice 100 may be positioned at any position along the length of base member 102. In an embodiment where only orifice 110 is provided in base member 102, orifice 110 is configured to be releasably engagable with a toner container, so as to allow toner to be poured through orifice 110. Therefore, a user may reuse the base member 102 for refilling purposes without being burdened with the need to repurchase a device for mating a toner container with the toner hopper to be refilled, as compared to the toner cartridge 28 shown in FIG. 10. Preferably, the remainder of base plate 102 is configured to substantially close the toner hopper, so as to prevent inadvertent spillage or dispersal of toner during a refill operation. Generally, it is not necessary for the base member to provide an air-tight seal with the toner hopper. Rather, base member 102 may be configured to mate with the engagement surface of the toner hopper to be refilled, such as surface 20 of toner hopper 16 shown in FIG. 10, for example. By constructing the engagement device 100 as such, users may refill a toner hopper with a generically shaped toner container, without the risk of spilling toner during a refill operation, thereby avoiding the high costs associated with the purchase of specially manufactured refilling cartridges such as cartridge 28 shown in FIG. 10.

Figure 3:
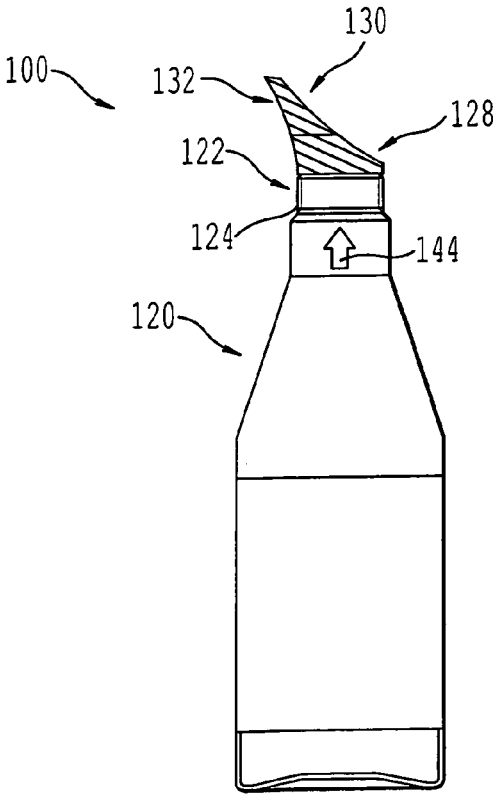
FIG. 3 is a partial cross-sectional view of the sealing film shown in FIG. 2 provided on a toner refill container.
Figure 4:
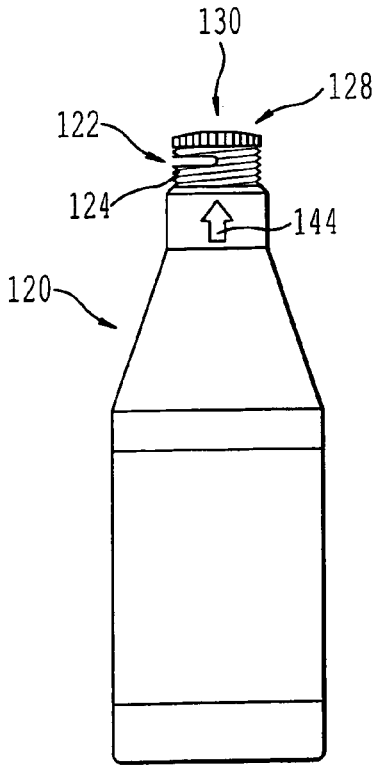
FIG. 4 is a side elevational view of the sealing film and toner refill container shown in FIG. 3.

Preferably, orifice 104 is in the form of annular orifice 112, having an annular wall 114 with an outer surface 116 and an inner surface 118. Preferably, inner surface 118 is configured to provide an interference fit with an outlet of a toner container. For example, referring to FIG. 3, toner container 120 includes an opening portion 122. As shown in FIGS. 3 and 4, outlet portion 122 is provided with threads 124 for threadably engaging with a cap (not shown). Alternatively, outlet 122 may be provided with a smooth outer surface and/or at least one ridge for snap fitting with a corresponding cap (not shown). In an embodiment where outlet 122 is provided with threads 124, inner surface 118 of orifice 112 may be provided with threads 126 which correspond to threads 124. Alternatively, inner surface 118 may be provided with a plurality of contours, such as ridges, which are configured to snap fit with threads 124. Alternatively, if outlet 122 is provided with at least one ridge, inner surface 118 may also be provided with contours to provide a snap or slip fit with such a ridge. As used herein, "interference fit" is defined as including at least one of (1) threaded engagements such as between a bolt and a nut, (2) a slip fit such as that provided between two contacting surfaces, and (3) snap fitting where corresponding ridges interfere with each other upon insertion and withdrawal.

Preferably, base member 102 is configured such that the overall height 111 of base member 102 is such that base member 102 does not interfere with other internal components in the image forming apparatus which includes the toner hopper to be refilled, such that base member 102 may be left mated to the toner hopper during operation of the image forming apparatus. For example, base member 102 may have a an overall height of approximately one inch, which may prevent base member 102 from interfering with other mechanisms in certain image forming apparatuses so that base member 102 may be left inside an image forming apparatus, engaged with its toner hopper during operation. However, the maximum overall height of base member 100 will be dictated by the specific characteristics of the image forming apparatus. By constructing base member 102 as such, it is unlikely that base member 102 will be lost between uses.

Figure 2:
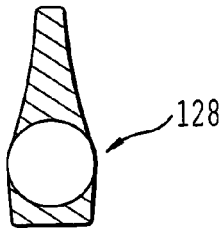
FIG. 2 is a top view of a sealing film for a toner refill container.

As shown in FIGS. 2–4, engagement device 100 preferably includes a removable seal 128 provided on a toner container 120. Sealing member 128 may be in the form of a foil or thin film that is bonded or adhered to opening 122 through partial melting or adhesive. Furthermore, sealing member 128 preferably includes an adhesive portion 130 provided with adhesive on at least one side of adhesive portion 130. In one embodiment, adhesive portion 130 may be formed on an extension 132 of sealing member 128. Preferably, adhesive portion 130 is configured to engage with an outer surface of a toner hopper when toner container 120 is engaged with orifice 104 (discussed in detail below). In this embodiment, it is also preferably that orifice 104 be configured to allow removable sealing member 128 to contact a slidable lid of a toner hopper when base member 102 is mated to the toner hopper, and when the toner container is engaged with orifice 104. By constructing orifice 104 as such, a refilling operation using the engagement device 100 is further enhanced by allowing the toner container to be inserted into orifice 104 with sealing member 128 remaining attached to opening 122 of the toner container, and using the movement of the toner hopper lid to peel sealing member 128 from opening 122, discussed in detail below.

Figure 5:
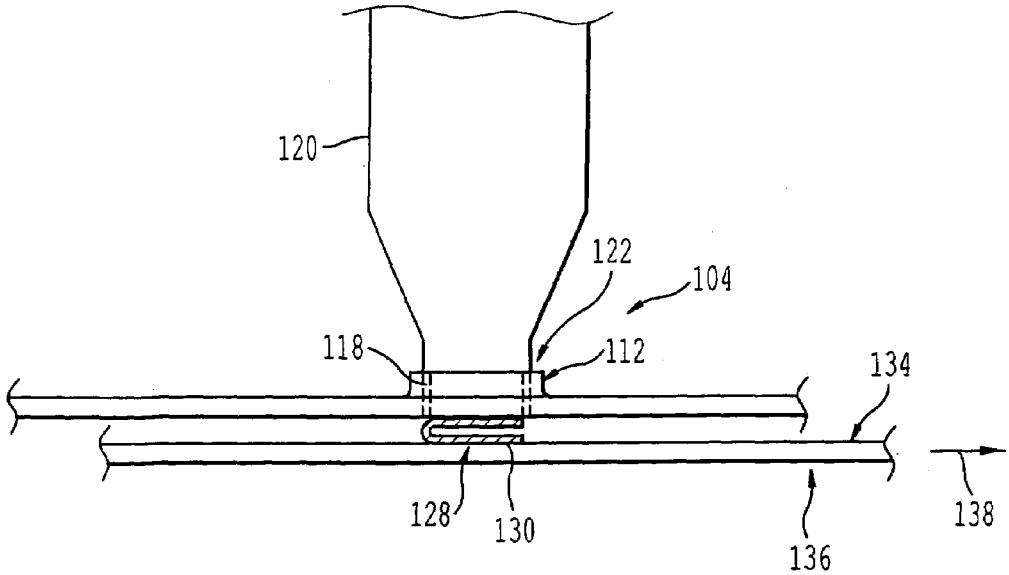
FIGS. 5–7 are side elevational views illustrating a refilling operation using the toner hopper engagement device shown in FIG. 1.
Figure 6:
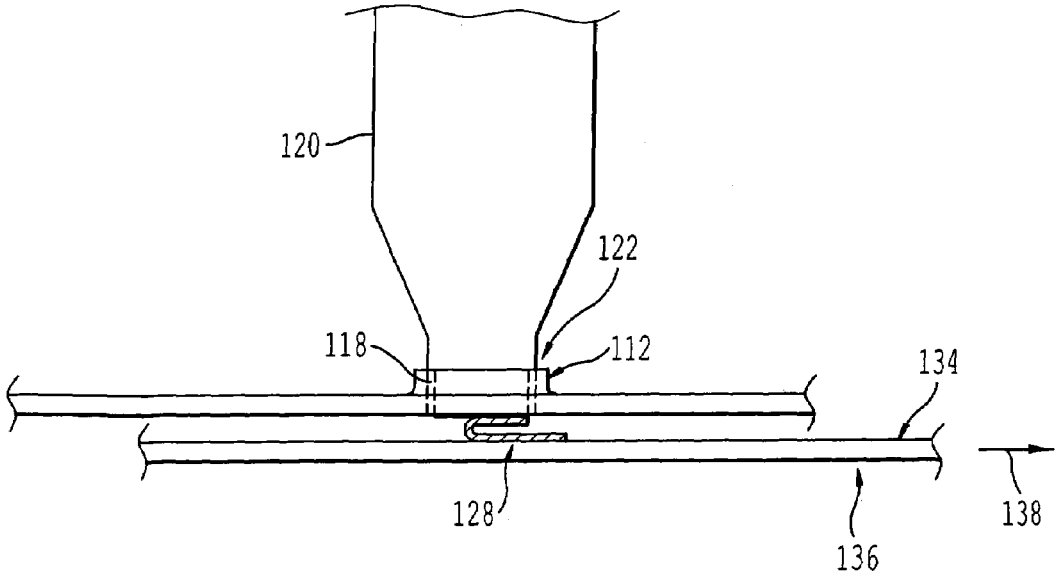
Figure 7:
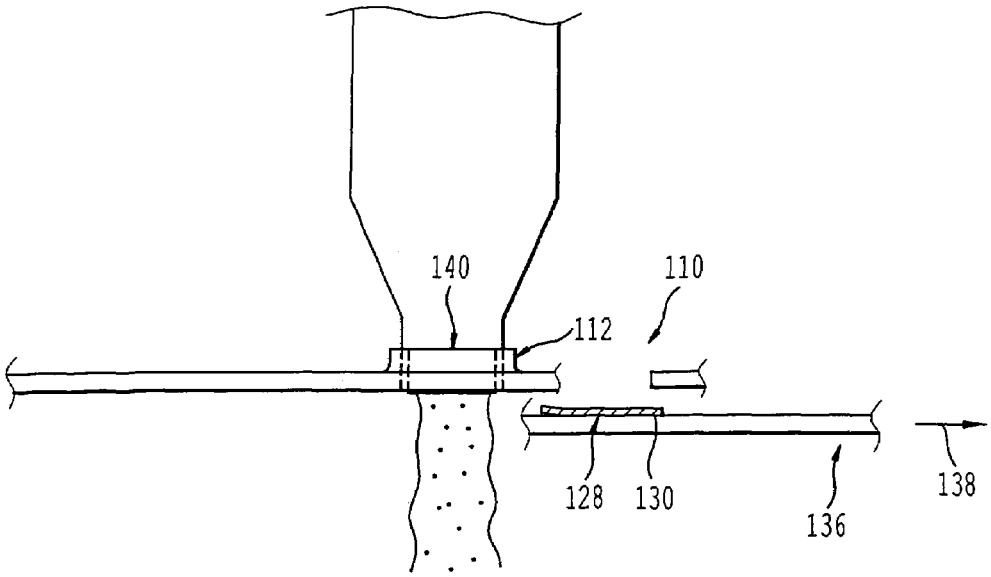
Figure 8:
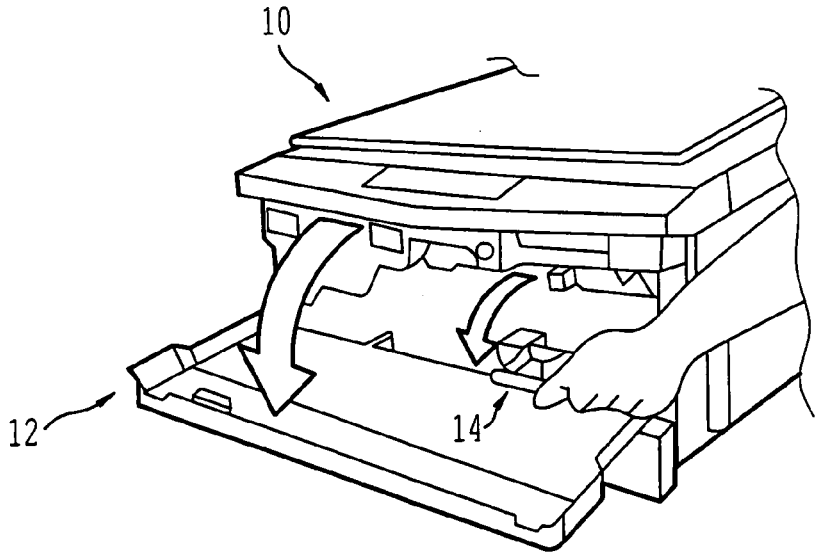
FIG. 8 (BACKGROUND ART)
FIG. 8 is a perspective view illustrating the movement of an access panel of an image forming apparatus.
Figure 9:
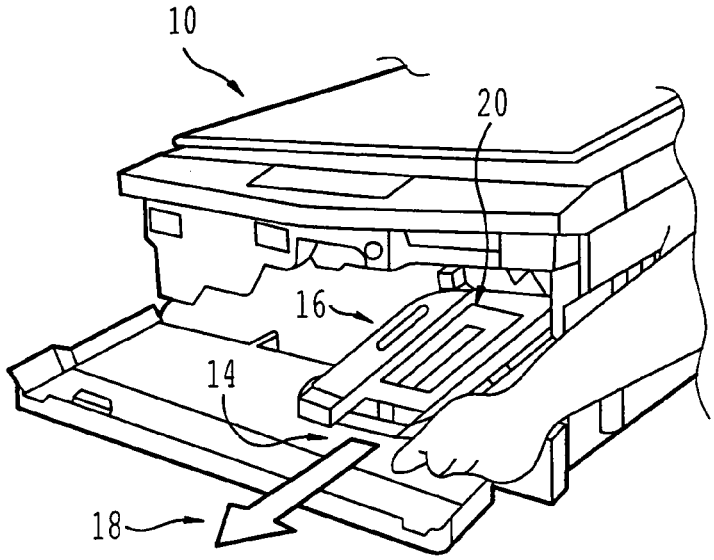
FIG. 9 (BACKGROUND ART)
FIG. 9 is a perspective view of an image forming apparatus illustrating the movement of a hopper of the image forming apparatus.
Figure 10A:
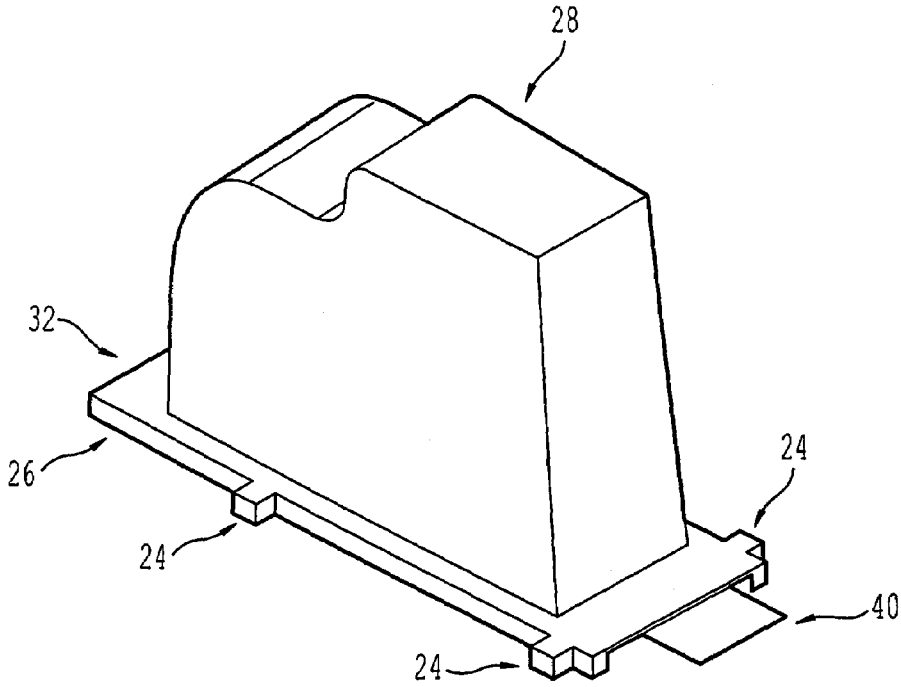
FIG. 10a (BACKGROUND ART)
FIG. 10 is an exploded perspective view of a hopper and a refill cartridge.
Figure 10B:
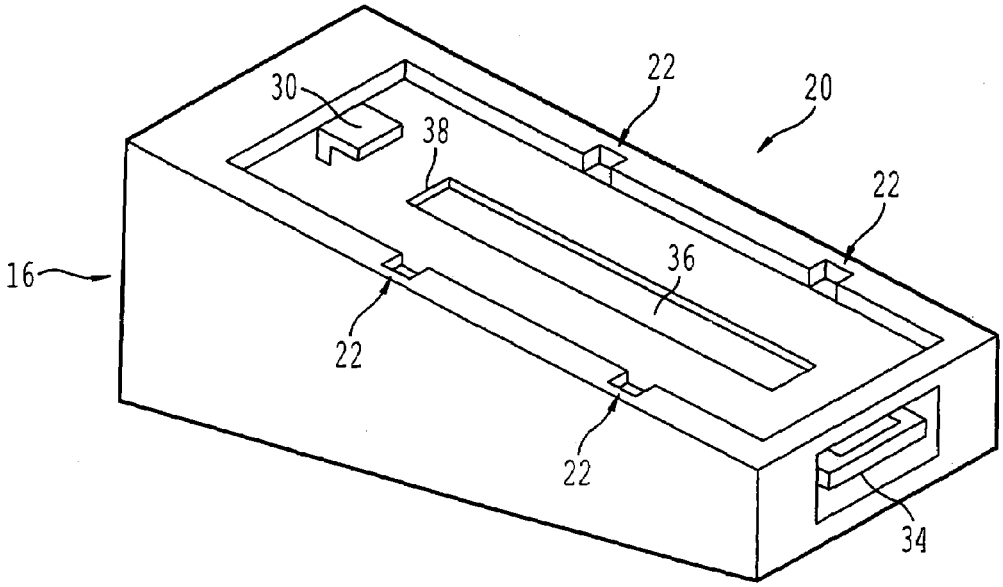
FIG. 10b (BACKGROUND ART)
Figure 11:
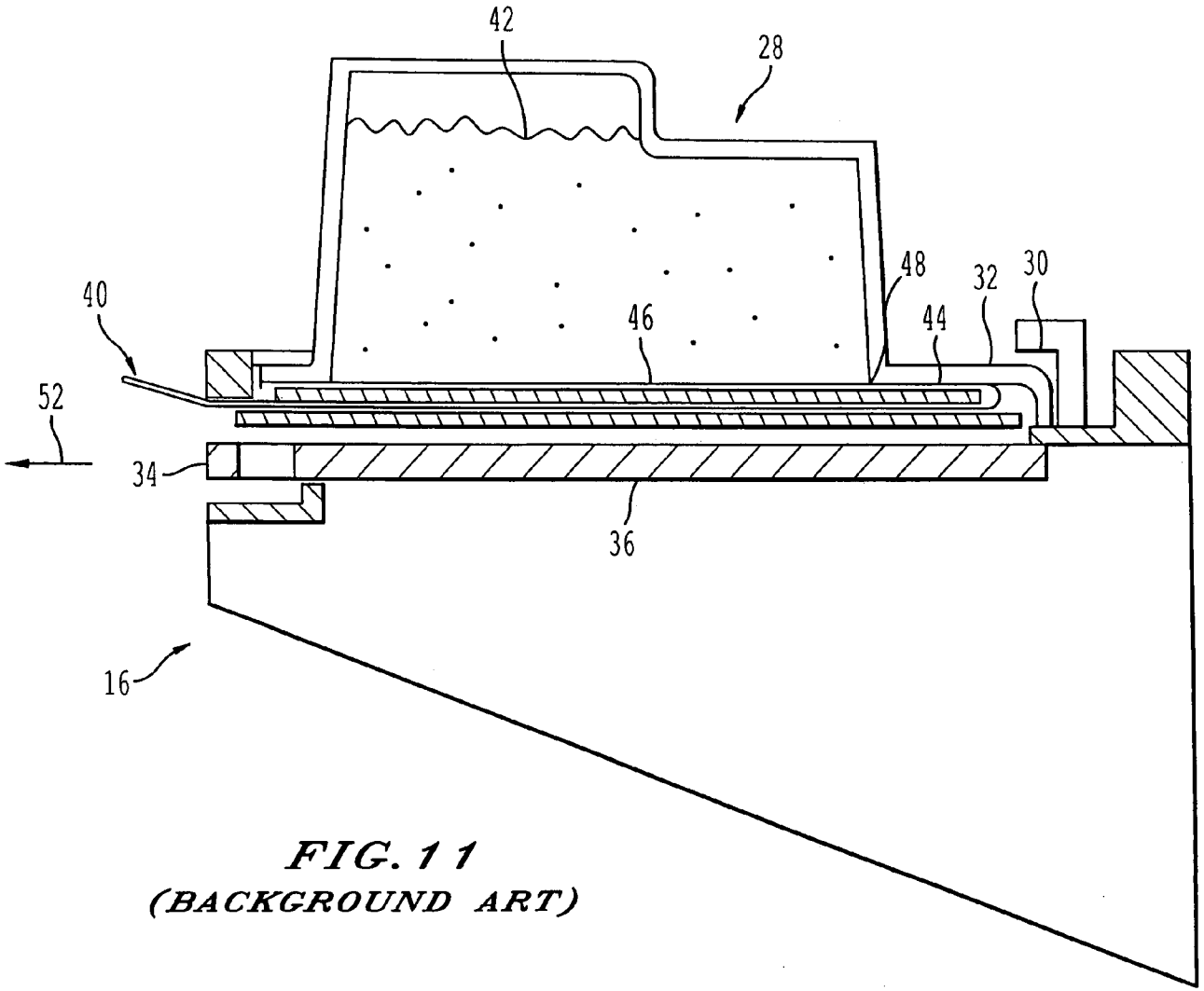
FIG. 11 (BACKGROUND ART)
FIGS. 11–13 are cross-sectional views illustrating a refilling operation using the refill cartridge and hopper shown in FIG. 10.
Figure 12:
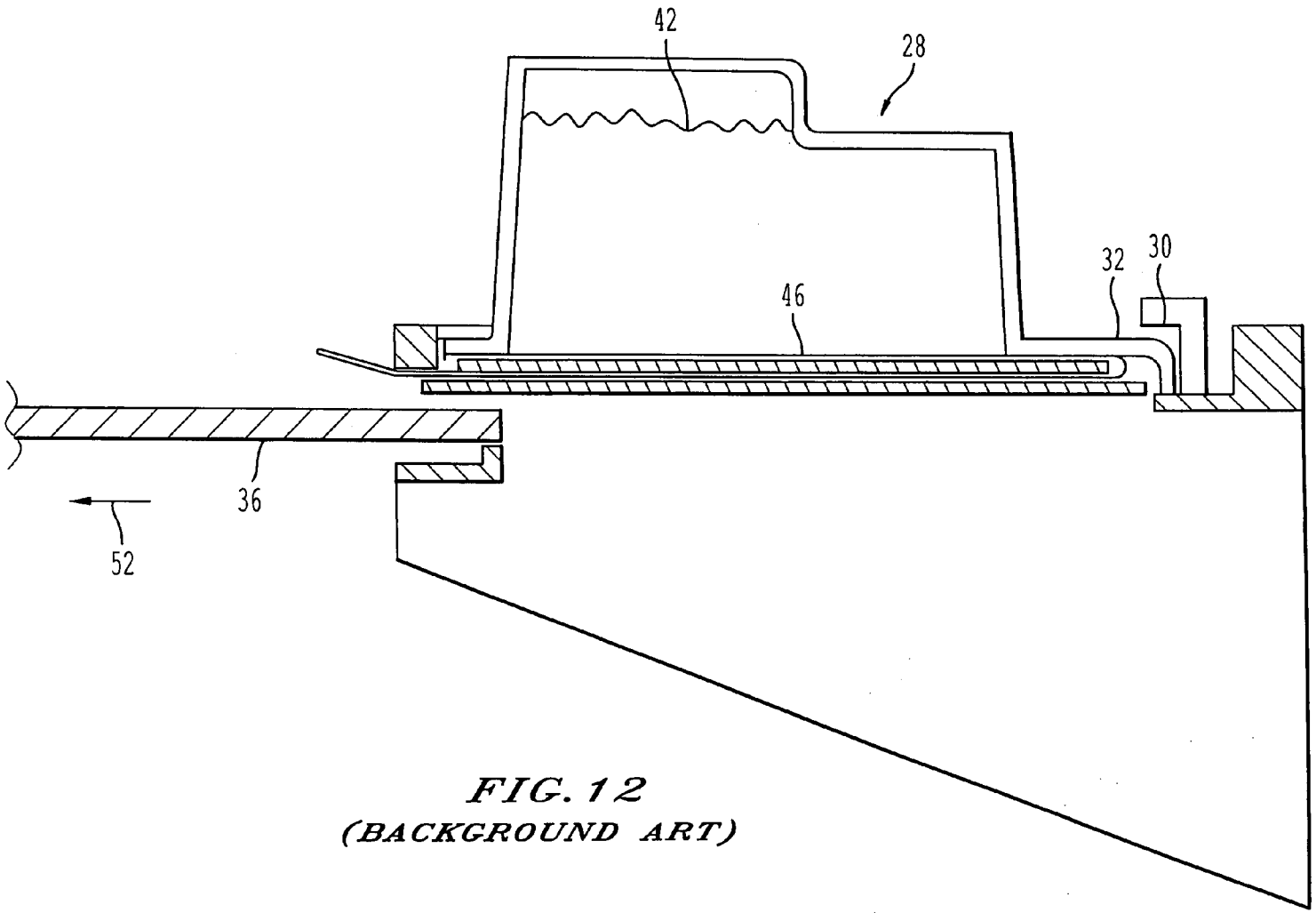
FIG. 12 (BACKGROUND ART)
Figure 13:
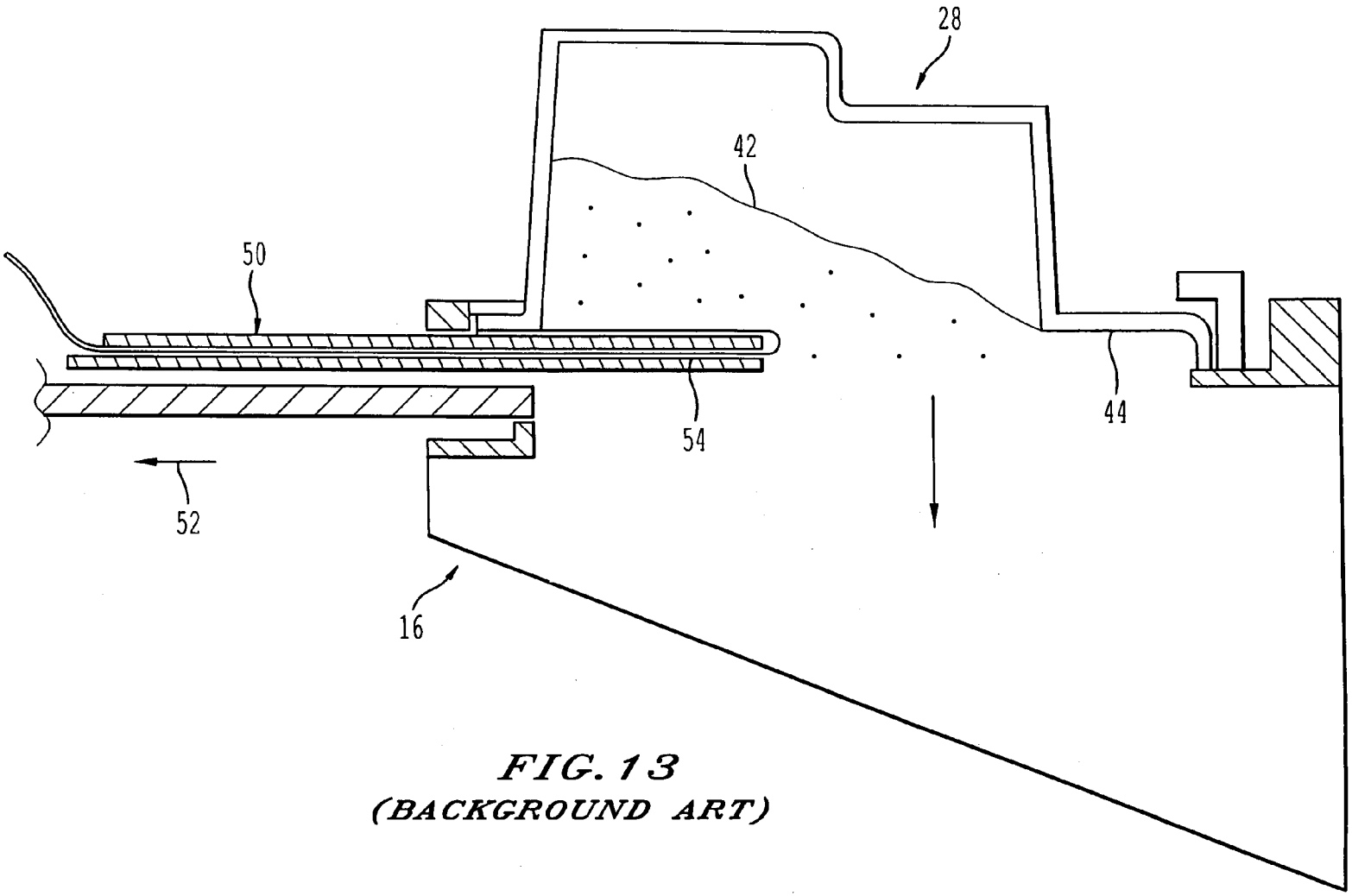
FIG. 13 (BACKGROUND ART)

Referring now to FIGS. 5–7, a refilling operation using the engagement device according to the present invention will be described. As shown in FIG. 5, toner bottle 120 is engaged with orifice 104. In this embodiment, orifice 104 is in the form of annular orifice 112. As shown in FIG. 5, opening 122 of toner container 120 is inserted into orifice 112 such that adhesive portion 130 of sealing member 128 engages with upper surface 134 of toner hopper lid 136. In this embodiment, toner hopper lid 136 generally corresponds to a slidable lid such as lid 36 of toner hopper 16 as shown in FIG. 10. Referring again to FIG. 5, since the adhesive provided on adhesive portion 130 is on a side of sealing member 128 which faces an exterior of toner container 120 (i.e., at least a portion of the adhesive does not face the interior of toner container 120 where toner is stored) adhesive member 130 can be engaged with upper surface 134 of toner hopper lid 136. As described above, inner surface 118 of orifice 112 is configured to provide an interference fit with toner container 120 with threads 126 which correspond to threads 124 provided on opening 122, or through contours configured to provide an interference fit with opening 122. Once toner container 120 has been inserted into the position shown in FIG. 5, a user may pull on a handle (not shown) of lid 136 along the direction of arrow 138 so as to cause adhesive member 130 to be pulled in the direction of arrow 138 and thereby peel sealing member 128 away from opening 122, as shown in FIG. 6. As shown in FIG. 7, once lid 136 is pulled clear of orifice 112, toner 140 can flow through opening 122 and into the toner hopper attached to lid 136.

In order to ensure that a user may properly align adhesive portion 130 in the proper direction so as to be peeled away from opening 122, engagement device 100 preferably includes indica 142, as shown in FIG. 1. Indica 142 may be in the form of any type of indica, such as an arrow or other mark. Preferably indica 142 is positioned so as to correspond to an indica 144 provided on toner bottle 120, as shown in FIGS. 3 and 4, such that indica 142 and 144 are in alignment with each other when toner bottle 120 is properly positioned in orifice 112, so that sealing member 128 is peeled from opening 122 when adhesive portion 130 is engaged with lid 136 and lid 136 is slid along the direction of arrow 138.

In one embodiment, base member 102 may include both orifice 112 and orifice 110. Preferably, orifice 110 is arranged to be on the same side of orifice 112 as the handle of the toner hopper lid. Therefore, when a toner hopper lid is pulled in the direction of arrow 138, as shown in FIGS. 1 and 7, and sealing member 128 is completely removed from lid 136, a user can retrieve sealing member 128 through orifice 110. Since orifice 100 is provided on a the same side of orifice 112 to which the toner hopper lid 136 is pulled, base member 102 prevents spillage and/or disbursement of toner during the refilling operation because toner hopper lid 136 overlaps orifice 110, thereby preventing the passage of toner upwards through orifice 110. A further advantage is achieved in that the since adhesive portion 130 of sealing member 128 is repeatedly aligned with approximately the same portion of toner hopper lid 136, adhesive portion 130 maintains that portion of toner hopper lid 136 in a clean state, such that in subsequent refilling operations, toner hopper lid is not fouled with debris which may prevent adhesive portion 130 from adhering to toner hopper lid 136.

By constructing toner hopper engagement device 100 with an orifice that is releasably engagable with a toner container, the present invention avoids the need for an end-user to purchase a specially manufactured toner refilling device or container, which has specialized components for coupling with known hopper devices. Rather, an end-user may purchase a single engagement device and thereafter purchase generically-shaped toner containers to refill the toner hoppers of their image forming devices. Since specialized containers are often complicated and/or expensive to design, manufacture or maintain, an end-user can avoid the cost and inconvenience associated with buying a complicated toner refilling device by using the engagement device of the present invention.

Furthermore, by providing the engagement device with a sealing member provided on a toner container where the sealing member has an adhesive portion configured to engage an outer surface of a sliding-type toner hopper lid, the present invention allows a refilling operation to be performed while the toner reservoir of the toner hopper is substantially sealed off from the outer atmosphere so that inadvertent spillage or dispersion of toner is substantially prevented.

This is important because the refill toner market perceives that the average office worker who is assigned that task of refilling image forming apparatuses is typically between the ages of late teens and early 30s and wears at least some white clothing. Therefore, it is important that refilling devices for image forming apparatus be easy to use and prevent inadvertent spillage or dispersal of toner.

A toner container according to another aspect of the present invention will now be described.

As discussed above with regard to the toner hopper engagement device 100, a toner container 120 as shown in FIGS. 2–4 is particularly useful for refilling toner hoppers of image forming apparatuses. In particular, where an engagement device such as toner hopper engagement device 100 is used for refilling an image forming apparatus, a toner container having adhesive portion 130 allows the toner hopper, such as toner hopper 16 shown in FIG. 10 for example, to be refilled without the risk of toner being inadvertently spilled or dispersed during refilling.

Preferably, adhesive portion 130 is formed on extension 132 of sealing member 128. Preferably, extension 132 has a length approximately equal to a diameter of opening 122. When constructed as such, adhesive portion 130 can be contained beneath a cap (not shown) used to protect sealing member 128 during transport and/or sale of toner container 120. Furthermore, with such a length, adhesive portion 130 can be engaged with a substantial portion of a toner hopper lid, such as lid 36 of toner hopper 16 shown in FIG. 10, during a refilling operation. As illustrated in FIGS. 5–7, when toner container 120 is inserted into orifice 112, adhesive portion 130 engages toner hopper lid 136. As lid 136 is pulled in the direction of arrow 138, sealing member 128 is peeled from opening 12 of toner container 120. Thereafter, as lid 136 is moved clear of opening 122, toner 140 contained in contained 120 freely flows into the toner hopper (not shown). Therefore, a toner hopper may be refilled without the risk that toner is inadvertently spilled.

A toner refilling kit according to a further aspect of the present invention will be described below.

A toner refill kit, according to the present invention, may include a toner hopper engagement device 100 having at least one orifice, and a toner container 120 having a sealing member 128 removably attached to an opening 122 of toner container 120. According to the present embodiment, toner hopper engagement device 100 and toner container 120 may be packaged in any known manner. By providing a toner refilling kit with such a toner hopper engagement device and a toner container, the burden on businesses, for example, who own or lease photocopiers, is significantly reduced. In particular, the refilling kit according to the present embodiment allows the user of photocopiers or image forming apparatuses to reduce the number of different specialized toner refill kits needed to refill different types of photocopiers or other image forming apparatuses they may operate. For example, since toner bottle 120 is widely used for many different kinds of photocopiers and image forming apparatuses, the refilling kit according to the present embodiment is relatively simple to manufacture. For example, although toner hopper engagement device 100 is specially designed and manufactured, toner container 120, excluding adhesive portion 130, is widely known and readily available. Therefore, the overall cost of design and manufacturing the refilling kit according to the present embodiment, is significantly reduced over that of the refilling cartridge of that shown in FIGS. 10–13. Furthermore, once a user has purchased a refilling kit according to the present embodiment, the toner hopper engagement device 100 can be retained and the user may simply choose to purchase additional toner containers 120, separately from the engagement device 100, which is not an option for purchasers of the toner cartridges 28 shown in FIGS. 10–13.

Numerous additional modifications and variations of the present invention are possible in light of the above teachings. It is therefore to be understood that within the scope of the appended claims, the present invention may be practiced otherwise than as specifically described herein.

The invention claimed is:

1. A toner hopper engagement device comprising:

a unitary base member configured to engage a toner hopper of an image forming apparatus which has a sliding-type toner hopper lid;

a first orifice provided on said unitary base member and configured to allow toner to pass through said unitary base member into the hopper; and a second orifice provided on the unitary base member and positioned to be on a same side of said first orifice towards which the toner hopper lid is pulled to be opened.

2. The engagement device according to claim 1, wherein said first orifice comprises a toner container engagement portion configured to be releasably engageable with a toner container.

3. The engagement device according to claim 2, wherein said toner container engagement portion comprises an annular wall having an inner and outer surface, wherein said inner surface of said annular wall includes contours configured to provide an interference fit with an outlet of a toner container.

4. The engagement device according to claim 3, wherein said contours comprise threads.

5. The engagement device according to claim 3, wherein said contours comprise ridges.

6. The engagement device according to claim 2, further comprising a sealing member provided on an outlet end of a toner container, wherein said toner container engagement portion is configured to be releasably engageable with the outlet of the toner container.

7. The engagement device according to claim 6, wherein said sealing member includes an adhesive portion on a side facing an exterior of the toner container.

8. The engagement device according to claim 7, wherein said first orifice is configured to allow said adhesive portion to contact an outer surface of a lid of the hopper when said engagement device is engaged with said hopper and when the toner container is engaged with said orifice.

9. The toner refill kit according to claim 8, wherein said second orifice is configured to allow a user access to the film contacting the lid of the hopper.

10. The engagement device according to claim 7, wherein said toner container engagement portion is configured to allow said adhesive portion to contact a surface of a lid of the hopper when said engagement device is engaged with the hopper and when the toner container is engaged with said toner container engagement portion.

11. The engagement device according to claim 2, further comprising:

a first indicia provided on a toner container adjacent the opening of the toner container; and a second indicia provided on said unitary base member adjacent said toner container engagement portion, said second indicia positioned to indicate a desired position of said first indicia when the toner container is engaged with said toner container engagement portion.

12. The engagement device according to claim 1, wherein said unitary base member includes protrusions configured to releasably engage with receptacles formed on the toner hopper.

13. The engagement device according to claim 1, further comprising a film provided on an outlet of a toner container, wherein said first orifice is configured to be releasably engageable with said outlet.

14. The engagement device according to claim 1, further comprising:

a first indicia provided on a toner container adjacent the opening of the toner container; and a second indicia provided on said unitary base member adjacent said first orifice, said second indicia positioned to indicate a desired position of said first indicia when the toner container is engaged with said orifice.

15. The toner refill kit according to claim 1, wherein said second orifice is configured to allow toner to pass through said unitary base member into the hopper.

16. A toner container comprising:

a toner storage portion having an opening;

a sealing member attached to said opening;

an adhesive portion provided on said sealing member having adhesive on at least a portion of said adhesive portion which does not face an interior of said toner storage portion; and an indicia adjacent said opening, said indicia positioned so as to indicate a proper position of said toner container when said toner container is engaged with a toner hopper engagement device provided on a toner hopper of an image forming apparatus having a sliding type lid, so that said adhesive portion may be peeled off by a movement of the lid of the toner hopper.

17. The toner container according to claim 16, wherein said adhesive portion has a length approximately equal to a diameter of said opening.

18. A toner refill kit comprising:

a unitary base member configured to engage a toner hopper of an image forming apparatus which has a sliding-type toner hopper lid;

a toner container having a toner storage portion and an opening;

a first orifice provided on said unitary base member and configured to allow toner to pass through said unitary base member into the hopper, said first orifice being releasably engageable with said opening; and a second orifice provided on the unitary base member and positioned to be on a same side of said first orifice towards which the toner hopper lid is pulled to be opened.

19. The toner refill kit according to claim 18, wherein said first orifice comprises a toner container engagement portion configured to be releasably engageable with said toner container.

20. The toner refill kit according to claim 19, wherein said toner container engagement portion comprises an annular wall having an inner and outer surface, wherein said inner surface of said annular wall includes contours configured to provide an interference fit with said opening of said toner container.

21. The toner refill kit according to claim 20, wherein said contours comprise threads.

22. The toner refill kit according to claim 20, wherein said contours comprise ridges.

23. The toner refill kit according to claim 19, further comprising a sealing member provided on said opening of said toner container, wherein said toner container engagement portion is configured to be releasably engageable with said opening outlet of said toner container.

24. The toner refill kit according to claim 23, wherein said sealing member includes an adhesive portion on a side facing an exterior of said toner container.

25. The toner refill kit according to claim 24, wherein said first orifice is configured to allow said adhesive portion to contact an outer surface of a lid of the hopper when said unitary base member is engaged with said hopper and when said opening is engaged with said first orifice.

26. The toner refill kit according to claim 25, wherein said second orifice is configured to allow a user access to the film contacting the lid of the hopper.

27. The toner refill kit according to claim 24, wherein said toner container engagement portion is configured to allow said adhesive portion to contact a surface of a lid of the hopper when said unitary base member is engaged with the hopper and when said opening is engaged with said toner container engagement portion.

28. The toner refill kit according to claim 19, further comprising:

a first indicia provided on a toner container adjacent said opening of said toner container; and a second indicia provided on said unitary base member adjacent said toner container engagement portion, said second indicia positioned to indicate a desired position of said first indicia when said opening is engaged with said toner container engagement portion.

29. The toner refill kit according to claim 28, wherein said adhesive portion has a length approximately equal to a diameter of said opening.

30. The toner refill kit according to claim 18, wherein said unitary base member includes protrusions configured to releasably engage with receptacles formed on the toner hopper.

31. The toner refill kit according to claim 18, further comprising a sealing member provided on said opening of said toner container, wherein said first orifice is configured to be releasably engageable with said opening.

32. The toner refill kit according to claim 18, further comprising:

a first indicia provided on said toner container adjacent said opening of said toner container; and a second indicia provided on said unitary base member adjacent said first orifice, said second indicia positioned to indicate a desired position of said first indicia when said toner container is engaged with said first orifice.

33. The toner refill kit according to claim 18, wherein said second orifice is configured to allow toner to pass through said unitary base member into the hopper.

* * * * *